United States Patent [19]

Hull et al.

[11] Patent Number: 5,056,778

[45] Date of Patent: Oct. 15, 1991

[54] LIQUID FILLED DUMBBELL

[76] Inventors: Harold L. Hull, 401 Canyon Way, #43, Sparks, Nev. 89434; Dennis J. Waite, 2245 Hedgewood Dr., Reno, Nev. 89509

[21] Appl. No.: 505,821

[22] Filed: Apr. 6, 1990

[51] Int. Cl.[5] ..... A63B 21/075

[52] U.S. Cl. ..... 272/122; 272/119; 272/130

[58] Field of Search ..... D21/196, 197; 272/119, 272/122, 123, 128, 130, 143, DIG. 1, DIG. 9, 900, 117; 273/DIG. 30

[56] References Cited

U.S. PATENT DOCUMENTS

| | | | |
|---|---|---|---|
| 1,511,312 | 10/1924 | Alastalo | 272/119 |
| 3,334,899 | 8/1967 | Bosko | 272/122 |
| 3,756,592 | 9/1973 | Johnson | 272/57 R |
| 3,987,506 | 11/1976 | Markwitz . | |
| 4,040,619 | 8/1977 | Landi | 272/68 |
| 4,079,932 | 3/1978 | Schuetz | 272/75 |
| 4,146,222 | 3/1979 | Hribar | 272/70 |
| 4,351,526 | 9/1982 | Schwartz | 272/122 |
| 4,357,009 | 11/1982 | Baker | 272/96 |
| 4,596,387 | 6/1986 | Roberts | 273/DIG. 30 |
| 4,676,501 | 6/1987 | Hoagland et al. | 272/900 X |
| 4,685,665 | 8/1987 | Carlisle | 272/67 |
| 4,854,575 | 1/1988 | Wilson | 272/122 |
| 4,854,576 | 6/1988 | McWain | 272/123 |

*Primary Examiner*—Robert Bahr

[57] ABSTRACT

A dumbbell partially filled with a liquid such as water that has a passageway in the gripping portion with a valve to control the rate of flow and when the wrist is twisted, the liquid flows from one end of the dumbbell to the other thus providing an increasing controllable resistance to the wrist and arm muscles. Also the device may be attached to other portions of the body, such as a foot, by hook and loop fastener.

4 Claims, 2 Drawing Sheets

LIQUID FILLED DUMBBELL

FIELD OF THE INVENTION

This invention relates to dumbbell and more particularly to dumbbells partially filled with a liquid.

BACKGROUND OF THE INVENTION

In the past dumbbells have been provided which have been filled with a liquid such as water for the purpose of increasing the weight of the dumbbell such as U.S. Pat. No. 3,334,899 which provides for a hand-held dumbbell which is filled with water, etc., its principle purpose being to provide different sizes of dumbbells to be filled with varied amounts of liquid and is also concerned with transparency. The U.S. Pat. No. 4,854,576 also teaches a collapsible weight system involving a collapsible diaphragm to allow varied amounts of water to be sealed within it's structure to increase or decrease it's weight. U.S. Pat. No. 4,854,575 also teaches a fluid fillable, collapsible dumbell in a doughnut-shape.

The above patents teach water filled devices with their primary purpose being to use liquid and more particularly water as the weight medium, while the present invention is designed for a further purpose, that is, the control of the liquid as the device is moved out of it's horizontal plane which allows the liquid to flow from one chamber to another to create a progressive resistance, twisting principle of muscle development.

SUMMARY OF THE INVENTION

It is a primary object of the present invention to provide means to progressively stretch the muscles of the body such as wrist, arm, foot, legs, etc., by providing a device which allows fluid to flow from one chamber to another through a common passageway to reduce the weight of one chamber while increasing the weight of the other.

It is a further object to provide means to control the rate of flow of the liquid from one chamber to the other.

It is yet another object to provide access to the chambers for emptying or filling.

Yet another object is to provide means to hold the device by gripping with a hand.

Still another object is to provide adjustable means to attach the device to various portions of the body.

Yet another object is to provide means to control the rate of flow of the liquid from one chamber to another by simply squeezing the handle.

Another object in a second embodiment is to provide means to control the rate of flow by controlling an interior valve.

Other objects and advantages will become obvious when taken into consideration with the following drawings and specifications.

DETAILED DESCRIPTION OF THE DRAWINGS

Figure 1:
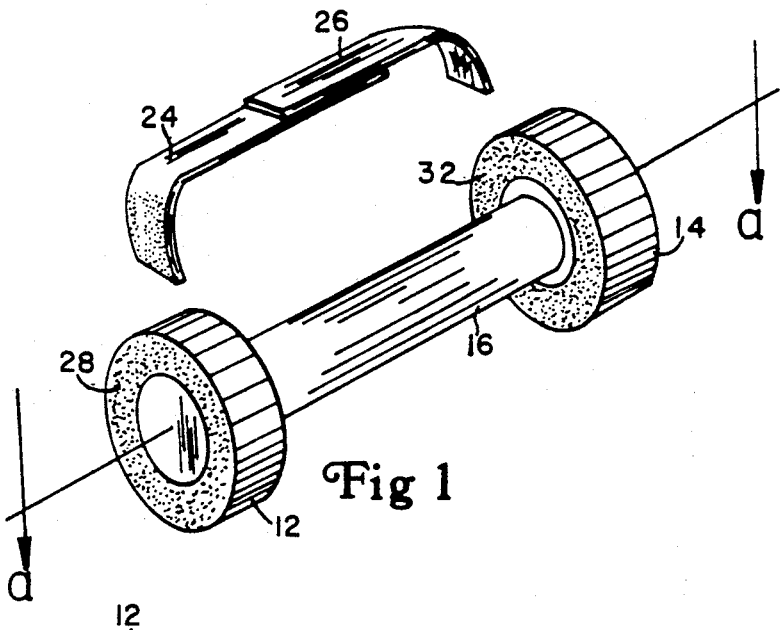
FIG. 1 is a perspective view of the preferred embodiment with hook and loop fastener attached straps being shown separately.
Figure 2:
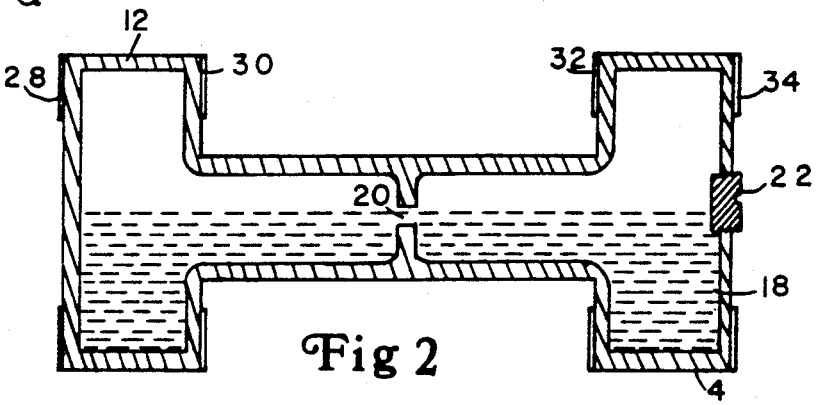
FIG. 2 is a section taken at a-a of FIG. 1 showing a closable orifice and partially filled with a liquid.
Figure 3:
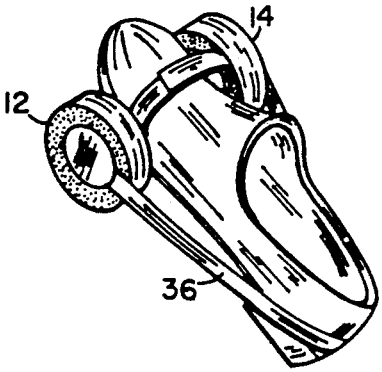
FIG. 3 is a perspective view of the device attached to a shoe.
Figure 4:
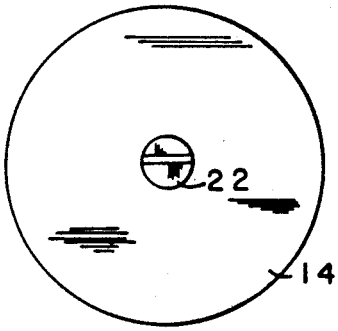
FIG. 4 is an end view showing a filling plug.

Referring now to the drawings in detail wherein like numerals represent like parts, FIG. 1 shows two hollow members 12 and 14 connected by hollow member 16 which acts as a hand grip when the device is used as a dumbbell, with hollow member 16 being made of a soft enough material which can be squeezed together by the hand thus restricting the flow of liquid through orifice 20 when the device is held with member 12 below the gravitational level of member 14 or visa-versa. 22 is a removable plug for filling or emptying the device while 24 and 26 are VELCRO strips cooperating with VELCRO rings 28, 30, 32, and 34 to provide means to attach the device to another member of the body such as a shoe as shown in FIG. 3 with 36 being an additional VELCRO strip.

Figure 5:
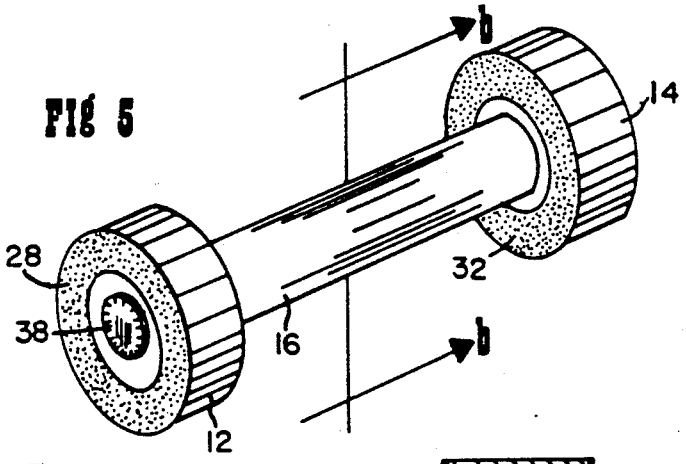
FIG. 5 is a perspective view of a second embodiment showing an external control member for controlling the rate of flow of the liquid.
Figure 6:
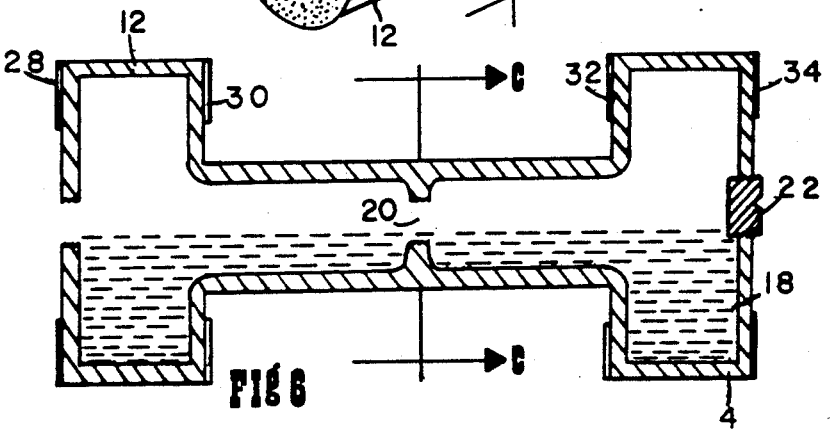
FIG. 6 is a section taken at b-b of FIG. 5 showing the internal threads of the main body without the control valve member in place.
Figure 7:
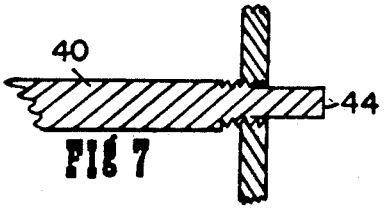
FIG. 7 is an internal conceptual view of the control valve in a closed position.
Figure 9:
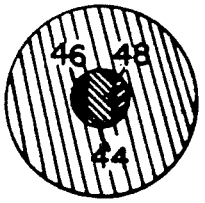
FIG. 9 is a section taken at c-c of FIG. 5 showing a variable control valve.
Figure 8:
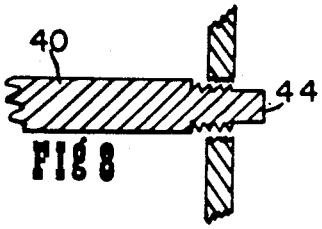
FIG. 8 is an internal conceptual view of the control valve in a partially open position.
Figure 11:
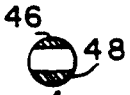
FIG. 11 is a section taken at d-d of FIG. 10.
Figure 10:
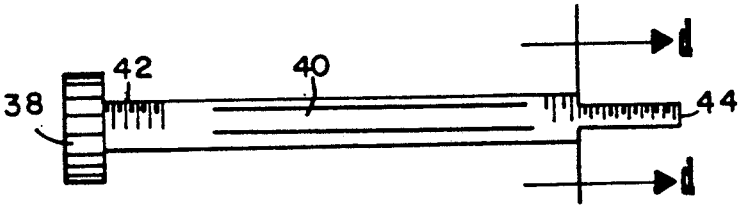
FIG. 10 is a side view of the control device by itself.

FIG. 5 and 10 teach a second embodiment with an external control 38 which controls screw 40 with threads 42 and 44 with flat spots 46 and 48 which allow the liquid 18 to flow from one chamber to another when in an open position.

Now it will be seen that we have provided a device which may be partially filled with a liquid such as water and when the device is used as a dumbbell, the liquid will flow to one chamber or the other when the device is held with one chamber lower than the other and as the liquid increases on one side and decreases on the other, it produces an increasing torque effect which exercises the wrist or other member of the body to which the device is attached in a new and unusual manner.

It will also be seen that we have provided means to control the rate of flow by simply squeezing the gripping portion or by a control device.

It will also be noted that we have provided a simple method to attach the device to portions of the body such as the foot, etc.

Also a simple means to fill or empty the device is provided.

We have disclosed a new application of an old principal and no attempt is made to explore all of the possible applications and embodiments that are possible, but has been presented and described in preferred form and by way of example only, and different variations and modifications can be made therein within the spirit of the invention. The invention, therefore, is not intended to be limited to any particular form or embodiment except in so far as such limitation are expressly set forth in the claims.

What we claim is;

1. A dumbbell comprising: at least two hollow containers; a liquid within the containers; a short straight connecting member between the containers; said at least two containers being mounted on the ends of said connecting member, and said at least two containers and connecting member of a size and shape as to be grippable and moveable by a single hand of a user; said connecting member having a passageway for allowing said liquid to flow from one container to another, said passageway having an orifice in the center of said passageway; a threaded member extending from outside one of the containers, through said one container, to said orifice in the passageway; said threaded member having a distal end cooperating with said orifice to provide an adjustable opening for said liquid to flow through said passageway; and at least one of said containers having a closable access to its interior from its exterior to allow filling and emptying of said liquid into said container.

2. The dumbbell of claim 1 wherein said closable access to allow filling and emptying of said liquid into said container is a threaded plug.

3. The dumbbell of claim 1 further comprising means for attaching said dumbbell to a body member of a user.

4. The dumbbell of claim 3 wherein said means for attaching said dumbbell to a body member of a user is a hook and loop fastener.

* * * * *